United States Patent [19]

Hull

[11] 3,939,794

[45] Feb. 24, 1976

[54] MARINE PUMP-JET PROPULSION SYSTEM

[76] Inventor: Francis R. Hull, 567 E. 26th St., Brooklyn, N.Y. 11210

[22] Filed: Sept. 25, 1973

[21] Appl. No.: 400,659

Related U.S. Application Data

[63] Continuation-in-part of Ser. Nos. 814,475, Feb. 17, 1969, Pat. No. 3,620,183, and Ser. No. 182,760, Sept. 22, 1971, Pat. No. 3,779,200.

[52] U.S. Cl. ..... 115/16; 60/221; 114/151

[51] Int. Cl.[2] ..... B63H 11/02; B63H 25/46

[58] Field of Search ..... 115/14, 11, 12 R, 12 A, 115/39, 42, 16; 114/61, 151; 60/221

[56] References Cited

UNITED STATES PATENTS

| | | | |
|---|---|---|---|
| 2,440,345 | 4/1948 | Neel | 114/61 |
| 2,735,392 | 2/1956 | Cox | 114/62 |
| 3,185,122 | 5/1965 | Pleuger | 114/151 |
| 3,447,324 | 6/1969 | French | 115/14 |

*Primary Examiner*—George E. A. Halvosa
*Assistant Examiner*—Sherman D. Basinger

[57] ABSTRACT

This invention relates to mechanically-actuated ahead-and-astern propulsion of marine vessels by means of a reversible hydraulic-jet ejector structure composed in part of oppositely-directed ejector stagings disposed centrally within a longitudinal open-channel conduit formed into the hull of the vessel. The reversible ejector structure may be alternately actuated by members of an oppositely-directed pair of remotely-driven pump-jet rotor nacelles submerged within the open-channel conduit, and disposed to supply high-velocity motive fluid to their respective secondary-nozzle pair members of the oppositely-directed ejector stagings. The pump-jet rotor nacelles may be remotely driven by right-angle drive shafts housed within supporting structural struts, and actuated by machinery internal to the vessel. The rotor assembly of each pump-jet nacelle may include variable-pitch blading whose operating adjustment may regulate the quantity and velocity of motive fluid supplied to its respective ejector staging.

4 Claims, 8 Drawing Figures

A
B
C
D
E
11
12
13
14
15
16
17
18
19
20
21
22
23

MARINE PUMP-JET PROPULSION SYSTEM

The present application is a continuation-in-part of my patent application Ser. No. 814,475 entitled "Marine Jet Propulsion System", filed Feb. 17, 1969 (now U.S. Pat. No. 3,620,183, issued Nov. 16, 1971) and my presently pending patent application Ser. No. 182,760 entitled "Marine Jet Propulsion System", filed Sept. 22, 1971 (now U.S. Pat. No. 3,779,200).

The invention includes as propelling means a reversible mechanically-actuated hydraulic-jet ejector structure composed in part of oppositely-directed thrust-augmenting secondary-nozzle ejector stagings disposed centrally within a longitudinal open-channel conduit formed by opposite chines or keels which depend downwardly from the hull structure of a marine vessel. The after end of this complex ejector passage may be warped or flared into an effective diffuser section to reduce fluid friction and provide location for a pivoted steering nozzle used in ahead propulsion. Each of the oppositely-directed ejector stagings includes a submerged remotely-driven pump-jet rotor nacelle which is structurally supported from the vessel and disposed to supply variable quantities of motive fluids at variable velocities to secondary-nozzle pair members of its respective ejector staging. Each pump-jet rotor is remotely driven via right-angle drive shafts by machinery internal to the marine vessel, and may include variable-pitch impeller blading actuated by servomotors common to the arts of hydraulic systems.

As used herein:

- the term 'fluid' shall refer to any liquid or gaseous medium;
- the term 'reversible' shall relate to a marine propulsion system which may direct its propelling fluid discharge with comparable facility in opposite directions;
- the term 'motive fluid' shall refer to the energized fluid stream which initiates a propulsion reaction, and to its piping system;
- the term 'suction fluid' shall relate to the fluid which is being accelerated by contact with a higher-velocity fluid stream;
- the term 'ejector passage' shall include the configuration of nozzle passageways within an ejector structure which guide the acceleration of suction fluids;
- the term 'ejector staging' shall relate to the ejector structure composed of motive nozzle and one or more secondary nozzles disposed in tandem with respect to each other downstream of the motive nozzle so that an upstream nozzle member discharges its fluid jet into the central bore of the next downstream nozzle member, and each secondary-nozzle member is disposed to admit suction fluids thereinto from the direction of positive differential pressure;
- the term 'open conduit' shall refer to a channel or trough having a non-continuous peripheral cross section used for guiding the flow of fluids which are exposed to the pressure of ambient surroundings;
- the term 'closed conduit' shall refer to a tube, pipe or duct having a continuous peripheral cross section which is capable of conveying fluids with pressures which are substantially different from that of its ambient exterior surroundings;
- the term 'open-channel conduit' shall relate to the exposed longitudinal ejector passage of the reversible hydraulic-jet ejector structure used to facilitate ahead-and-astern propulsion of marine vessels.

For a mobile vehicle which is propelled by the acceleration of fluids surrounding the vehicle, and where the intake of the fluid being accelerated through the propulsor is directed opposite the direction of final discharge, propulsion efficiency is given by the expression:

$$E = \frac{2V_s}{V_j + V_s} (E \text{ approaches } 100\% \text{ as } V_j \text{ approaches } V_s)$$

Where:

$V_s$ is the absolute velocity of the vehicle, and $V_j$ is the absolute final velocity of the propelling fluid leaving the propulsion system in the direction of final discharge.

Maximum theoretical propulsion efficiency in this case is limited to 100%. In a practical sense the highest propulsion efficiencies are attained where the maximum of fluid kinetic energy has been converted to propulsive thrust, and final discharge velocities relative to the vessel are very low.

With the declared objects in view together with others which will emerge as the description proceeds, the invention resides in the novel construction, assemblage and arrangement of elements which will be described more fully in the discussion, illustrated in the annexed drawings, and particularly pointed out in the claims.

LEGEND

Exhibit A

Figures 1, 2, 3, 4, 5, 6:
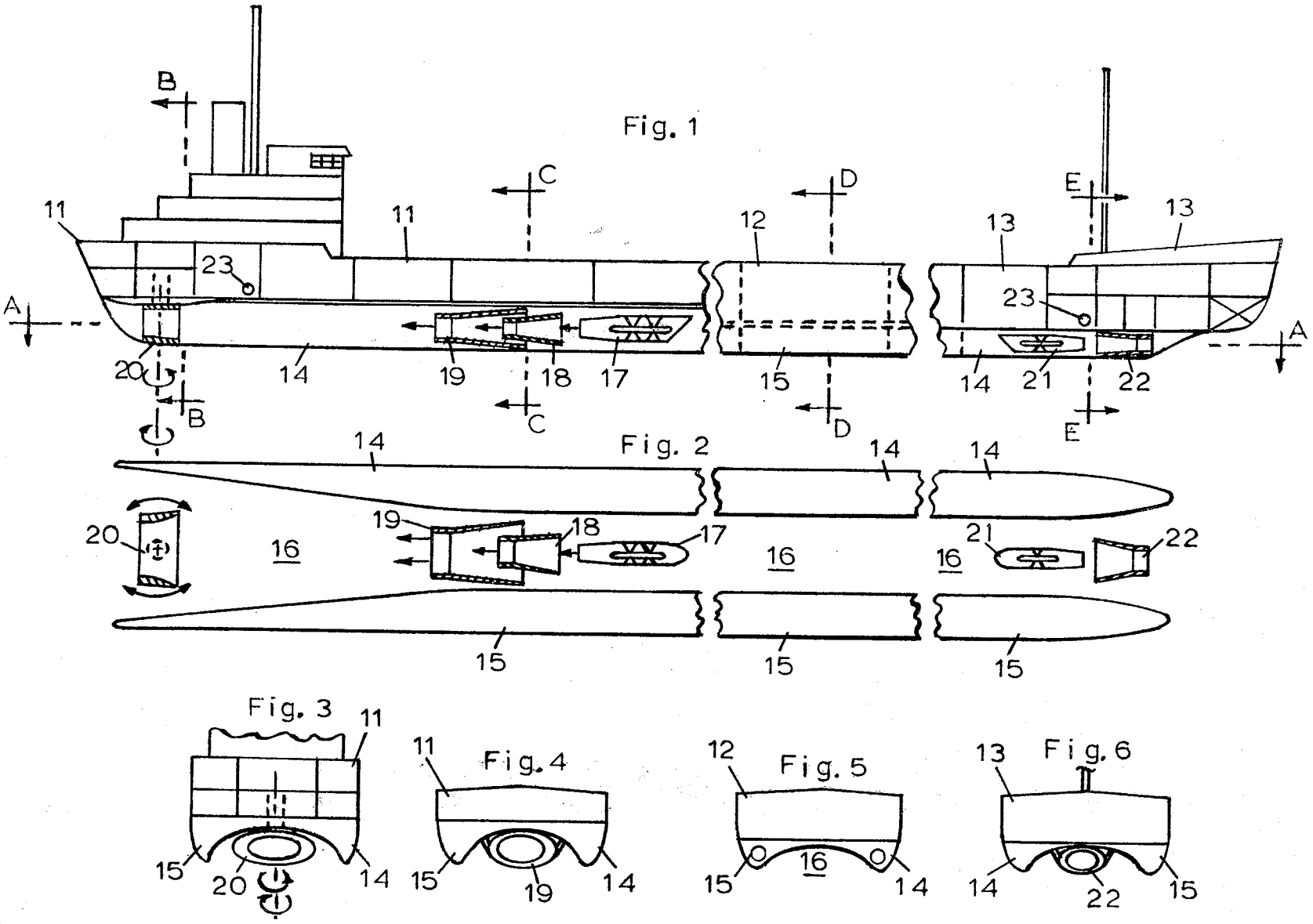
FIG. 1 is a partially segmented longitudinal sectional view of a semi-planing type of marine vessel which is propelled in the fore-and-aft direction by a reversible mechanically-actuated hydraulic-jet ejector structure formed in the hull structure of the vessel.
FIG. 2 is a longitudinal sectional view of the segmented reversible hydraulic-jet ejector structure taken along broken line A—A of FIG. 1.
FIG. 3 is a transverse sectional view of the ship structure substantially taken along line B—B of FIG. 1.
FIG. 4 is a transverse sectional view of the ship structure substantially taken along line C—C of FIG. 1.
FIG. 5 is a transverse sectional view of the ship structure substantially taken along line D—D of FIG. 1.
FIG. 6 is a transverse sectional view of the ship structure substantially taken along line E—E of FIG. 1.

11 Stern Section
12 Mid-body
13 Bow section
14 Left-side (port) bilge keel or chine
15 Right-side (starboard) bilge keel or chine
16 Ejector passage
17 2-Stage pump-jet nacelle for ahead propulsion
18 1st Stage secondary nozzle
19 2nd Stage secondary nozzle 20 Rotary steering nozzle
21 Single-stage pump-jet nacelle for astern propulsion
22 Single-stage secondary nozzle
23 Lateraly-disposed athwartship maneuvering tube
24 Annular pump-jet nacelle (ahead)
25 Nozzle discharge section
26 Nozzle throat
27 Protective intake grating
28 Support and transmission strut
29 Support and transmission strut
30 Internal centering strut
31 Internal centering strut
32 Right-angle drive shaft
33 Bevel gear (driver)
34 Right angle drive shaft
35 Bevel gear (driver)
36 Hydraulic transmission lines
37 Hydraulic transmission lines
38 Fixed bevel gear housing
39 Fixed bevel gear housing
40 Bevel gear (driven)
41 Drive shaft
42 Bevel gear (driven)
43 Drive shaft
44 2-Stage pump rotor hub
45 Variable-pitch impeller blades
46 Deflector
47 Fairing
48 Nozzle passage
49 Annular pump-jet nacelle (astern)
50 Nozzle discharge section
51 Nozzle throat
52 Protective intake grating
53 Support and transmission strut
54 Support and transmission strut
55 Internal centering strut
56 Internal centering strut
57 Right-angle drive shaft
58 Bevel gear (driver)
59 Right-angle drive shaft
60 Bevel gear (driver)
61 Hydraulic transmission lines
62 Hydraulic transmission lines
63 Fixed bevel gear housing
64 Fixed bevel gear housing
65 Bevel gear (driven)
66 Drive shaft
67 Bevel gear (driven)
68 Drive shaft
69 Single-stage pump rotor hub (astern)
70 Variable-pitch impeller blades
71 Deflector
72 Fairing
73 Nozzle passage The longitudinally disposed open-channel conduit of the reversible ejector structure is bounded by opposite chines or keels which depend downwardly from the vessel's hull structure. Oppositely-directed secondary-nozzle ejector stagings are centrally disposed in the open channel conduit to develop propulsive thrust in either propelling direction by discharging to adjacent ends of the ejector passage. A submerged remotely-driven pump-jet nacelle disposed to supply high-velocity motive fluids is an integral member of each oppositely-directed secondary-nozzle ejector staging. Each pump-jet nacelle is disposed to receive suction fluids from the direction of positive differential pressure when it is propelling the vessel.

The vessel may be steered in ahead propulsion by means of a pivoted steering nozzle. As shown in FIGS. 1, 2 and 3 the steering nozzle may be located centrally in the after end of the submerged longitudinal open conduit and disposed to rotate about a vertical axis. When the vessel has headway, waters from the after end of the submerged ejector passage are partially diverted into the large elliptical steering nozzle 20. When nozzle 20 is rotated about a vertical axis through an angular displacement from the fore-and-aft centerline, waters accelerated therethrough develop a substantial unbalanced thrust which reacts on the nozzle and the vessel's stern. The lateral component of this unbalanced thrust acts about the vessel's turning center to produce a moment about the vertical which alters the vessel's course.

The segmented semi-planing vessel shown in FIG. 1 may also be maneuvered by thrusting effects developed by laterally-disposed submerged reaction tubes 23. Operation of the maneuvering variation of the reversible jet-reaction ejector structure per se is described in the parent patent application Ser. No. 814,475 now U.S. Pat. No. 3,620,183 issued Nov. 16, 1971.

FIG. 1 depicts the general outline of a segmented and sectional view of a semi-planing type of marine vessel which is propelled in the fore-and-aft direction by a reversible mechanically-actuated hydraulic-jet ejector structure. The marine vessel shown in FIG. 1 is comprised of aft-body section 11 having any appropriate length (shown in partial longitudinal center section) mid-body section 12 of any appropriate length (shown in a full-section exterior view), and fore-body section 13 of any appropriate length (shown in partial longitudinal center section). A substantially coextensive submerged open-channel conduit or ejector passage 16 is longitudinally disposed below the normal waterline and defined in the bottom hull structure of marine vessel 11–13 inclusive by the boundaries of downwardly depending, left-side or port keel member 14 and right-side or starboard keel member 15.

Suitably disposed within the open-channel conduit, and supported from the vessel's hull structure by any suitable structural members, are widely spaced oppositely-directed pairs of secondary-nozzle ejector stagings 17–19 and 21–22 inclusive, each ejector staging discharging towards the most adjacent propelling end of the ejector passage 16. Ahead propulsion ejector staging 17–19 inclusive, which discharges to the adjacent after end of ejector passage 16, is composed of remotely-driven 2-stage pump-jet nacelle 17, 1st stage secondary-nozzle member 18 and 2nd stage secondary-nozzle member 19. Astern propulsion ejector staging 21–22 inclusive dischages towards the adjacent forward end of ejector passage 16, and is comprised of remotely-driven single-stage pump-jet nacelle 21 and secondary-nozzle member 22. The after section of submerged open-channel conduit 16 within the vessel aft-body section 11 may be warped or flared into an effective diffuser section adjacent the discharge of forward propulsion ejector staging 17–19, by altering the configuration of downwardly depending chine or keel members 14 and 15 (FIG. 2).

Arranged centrally within the diffuser section of submerged ejector passage 16 is pivoted steering nozzle 20, which is disposed to rotate about a vertical axis as shown in FIGS. 1, 2 and 3. The angular position of steering nozzle 20 with respect to its fore-and-aft axis is longitudinal open-channel conduit 16 is controlled by steering machinery housed within the vessel, and which may be any of a number of types presently common in the marine engineering arts. Elliptical steering nozzle 20 may be further stabilized in its vertical orientation by additional structural struts or braces (not shown).

Figure 7:
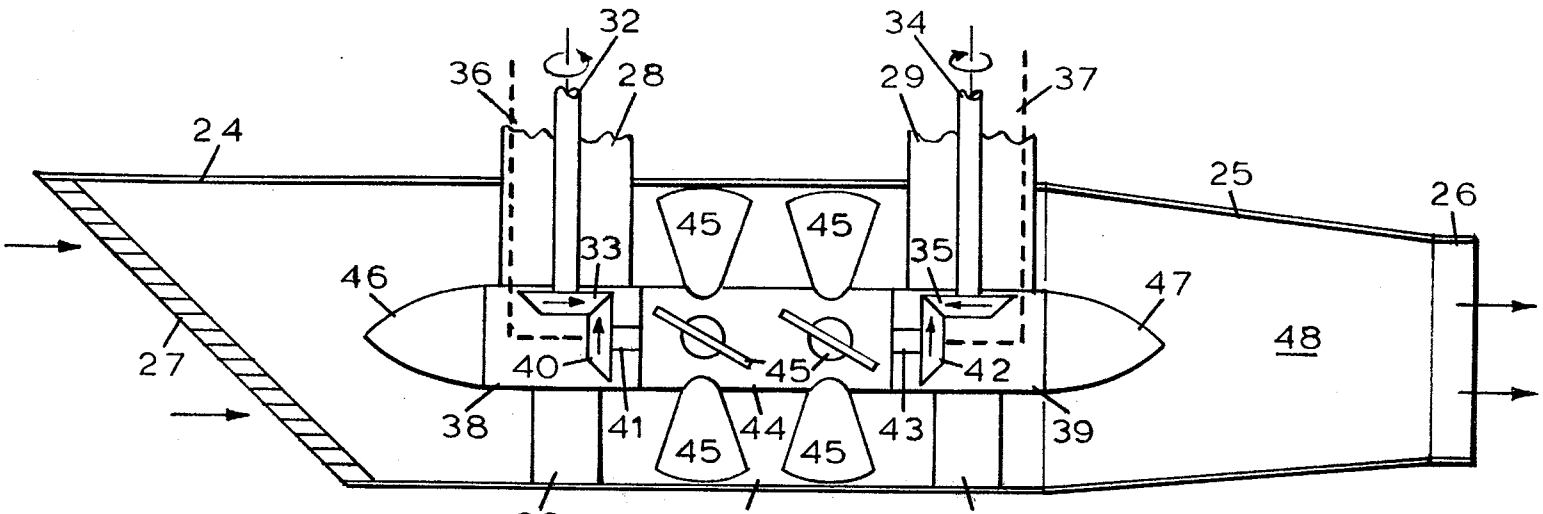
FIG. 7 is a longitudinal sectional view of a remotely-driven submerged 2-stage pump-jet nacelle assembly which is structurally supported by struts from the ship structure, and which may be used for ahead propulsion.

FIG. 7 is a longitudinal sectional view in simplified form of a remotely-powered 2-stage pump-jet nacelle assembly, as shown at 17 in FIGS. 1 and 2, to actuate ahead propulsion. Pump-jet nacelle 24–27 inclusive is a protective enclosure for rotor assembly 40–45 inclusive and includes annular housing 24, annular nozzle section 25, annular nozzle throat 26 and intake grating 27.

Rotor assembly 40–45 inclusive is supported by end bearings (not shown) about shaft members 41 and 43. The end bearing for shaft member 41 is suitably mounted in annular gear housing 38, which is suitably secured to support and transmission strut member 28. The end bearing for shaft member 43 is suitably mounted in annular gear housing 39, which is suitably secured to support and transmission strut member 29. Support and transmission strut members 28 and 29 are rigidly secured to the vessel structure outside of the boundaries of ejector passage 16. Support and transmission strut member 28 contains drive shaft 32 with bevel gear 33 and hydraulic supply line 36 as shown, while support and transmission strut member 29 contains drive shaft 34 with bevel gear 35 and hydraulic supply line 37 as shown. Shaft member 32 with bevel gear 33 and shaft member 34 with bevel gear 35 are counter-rotating with respect to each other, and may be simultaneously powered from internal machinery within the vessel.

Rotor assembly 40–45 may be driven simultaneously at attached bevel gear 40 by bevel gear 33 and at attached bevel gear 42 by bevel gear 35. Rotor assembly 40–45 includes 2 sets of variable-pitch impeller blades 45, which are adjusted by an internal hydraulic servomotor assembly (double-acting piston) of any of the types which are well-known in the hydraulic arts and, accordingly is not shown. The internal hydraulic blade operating mechanism is actuated by differences in hydraulic oil pressure supplied through lines 36 and 37 (shown in phantom) into the center of bevel gear and shaft assembly 40–41 and into the center of bevel gear and shaft assembly 42–43 from a hydraulic pump and oil reservoir carried inside the vessel. The angular pitch of all impeller blade members 45 may be simultaneously adjusted by remote pressure adjustments of the internal hydraulic servomotor system of rotor assembly 40–45.

Figure 8:
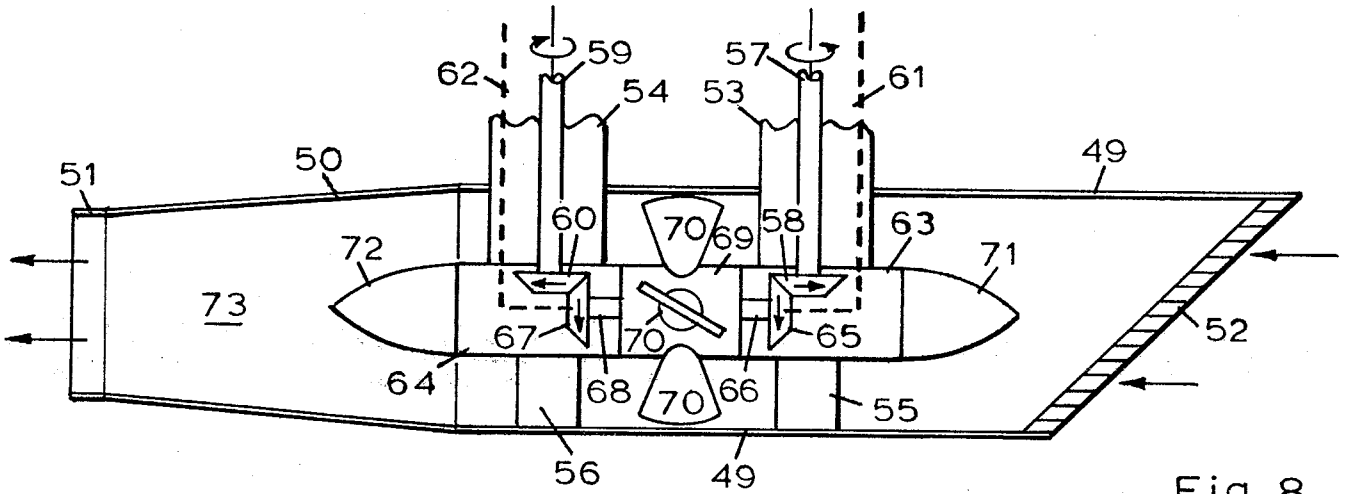
FIG. 8 is a longitudinal sectional view of a remotely-driven submerged single-stage pump-jet nacelle assembly which is structurally supported by struts from the ship structure, and which may be used for astern propulsion.

FIG. 8 is a longitudinal sectional view in simplified form of a remotely-powered single-stage pump-jet nacelle assembly, as shown at 21 in FIGS. 1 and 2 to facilitate astern propulsion. Pump-jet nacelle 49–52 inclusive is a protective enclosure for rotor assembly 65–70 inclusive and includes annular housing 49, annular nozzle section 50, annular nozzle throat 51 and intake grating 52.

Rotor assembly 65–70 inclusive is supported by end bearings (not shown) about shaft members 66 and 68. The end bearing for shaft member 66 is suitably mounted in annular gear housing 63, which is suitably secured to support and transmission strut member 53. The end bearing for shaft member 68 is suitably mounted in annular gear housing 64, which is suitably secured to support and transmission strut member 54. Support and transmission strut members 53 and 54 are rigidly secured to the vessel structure outside boundaries of ejector passage 16. Support and transmission strut member 53 contains drive shaft 57 with bevel gear 58 and hydraulic supply line 61 as shown, while support and transmission strut member 54 contains drive shaft 59 with bevel gear 60 and hydraulic supply line 62 as shown. Shaft member 57 with bevel gear 58 and shaft member 59 with bevel gear 60 are counter-rotating with respect to each other, and may be simultaneously powered from internal machinery within the vessel.

Rotor assembly 65–70 may be driven simultaneously; at attached bevel gear 65 by bevel gear 58 and at attached bevel gear 67 by bevel gear 60. Rotor assembly 65–70 includes single-stage variable-pitch impeller blades 70 which are adjusted by an internal hydraulic servomotor assembly (double-acting piston) of any of the types which are common in the hydraulic arts. The internal hydraulic blade operating mechanism is actuated by differences in hydraulic oil pressure supplied through lines 61 and 62 (shownin phantom) into the center of bevel gear and shaft assembly 65–66 and into the center of bevel gear and shaft assembly 67–68 from a hydraulic pump and oil reservoir carried inside the vessel. The angular pitch of all impeller blade members 70 may be simultaneously adjusted by remote pressure adjustments of the internal hydraulic servomotor system of rotor assembly 65–70.

It is, of course, well-known that conventional propeller-driven marine vessels are difficult to stop quickly, especially when they are heavily laden and propelled ahead under full power. Even after rotation of the propeller has been reversed under full power, these vessels normally travel ahead for many nautical miles before their momenta are counteracted.

This problem is considerably ameliorated by the present invention.

When the hydraulic-jet propelled marine vessel has headway and ducted axial pump 17 is shut off, sea water flowing in the longitudinal open-channel conduit of the reversible ejector structure exerts substantial drag forces on secondary-nozzle members 18 and 19 in the astern direction. When the marine vessel has sternway and ducted axial pump 21 is shut off, sea water flowing in the longitudinal open-channel conduit of the reversible ejector structure exerts substantial drag forces on secondary-nozzle member 22 in the ahead direction. The kinetic energy of the moving vessel causes sea water flowing in the longitudinal open-channel conduit relatively into an idle secondary-nozzle member to be accelerated thereinto, causing a dissipation of vessel energy by transfer of momentum. Sea water flowing in the longitudinal open-channel conduit and on into the enlarged inlet of an idle secondary-nozzle member also exerts substantial drag forces thereon which help to decelerate the vessel in the direction of relative fluid flow. When ejector propulsion stagings 17–19 and 21–22 are idle while the vessel has either headway or sternway, secondary-nozzle members thereof will exert substantial braking forces which greatly assist the positive and accurate control of vessel movement.

Accordingly, the reversible open-channel ejector structure functions as a reversible fluid brake or sea anchor which will rapidly decelerate a moving vessel in either the ahead or astern direction when ducted axial pumps 17 and 21 are shut off.

Having thus described the invention, what I claim as new and desire to secure by Letters Patent is:

1. A marine propelling device to facilitate ahead-and-astern propulsion comprising a reversible hydraulic-jet ejector structure extending longitudinally within the hull of a marine vessel and disposed below the normal waterline; said reversible ejector structure being bounded by sidewalls of a longitudinal open-channel conduit formed by downwardly depending chines or keels from the hull structure of said marine vessel; oppositely-directed thrust-augmenting secondary-nozzle ejector stagings centrally disposed in said open channel conduit to discharge towards their respective adjacent propelling end of said ejector structure; each ejector staging having a ducted axial pump disposed within said open-channel conduit to supply high-velocity motive fluids into the central bore of at least one adjacent secondary-nozzle member; the inlet casing of each ducted axial pump being disposed to admit pump suction fluids from the direction of positive differential pressure when underway and the outlet casing of each ducted axial pump being disposed to discharge high-velocity motive fluids therefrom.

2. The reversible hydraulic-jet ejector structure for marine propulsion of claim 1 wherein each ducted axial pump is mechanically powered by machinery internal to the marine vessel.

3. The reversible hydraulic-jet ejector structure for marine propulsion of claim 1 wherein the outlet casing of each ducted axial pump comprises a discharge nozzle.

4. The reversible hydraulic-jet ejector structure for marine propulsion of claim 1 wherein the rotor of each ducted axial pump includes variable-pitch impeller blades, and means for remotely adjusting the pitch angle of said variable-pitch impeller blading.

* * * * *